US009896304B2

(12) United States Patent
Flynn

(10) Patent No.: US 9,896,304 B2
(45) Date of Patent: Feb. 20, 2018

(54) SECURITY SYSTEM FOR ELEVATOR

(75) Inventor: Michael P. Flynn, Avon, CT (US)

(73) Assignee: OTIS ELEVATOR COMPANY, Farmingon, CT (US)

( * ) Notice: Subject to any disclaimer, the term of this patent is extended or adjusted under 35 U.S.C. 154(b) by 424 days.

(21) Appl. No.: 14/421,642

(22) PCT Filed: Aug. 14, 2012

(86) PCT No.: PCT/US2012/050751
§ 371 (c)(1),
(2), (4) Date: Feb. 13, 2015

(87) PCT Pub. No.: WO2014/028004
PCT Pub. Date: Feb. 20, 2014

(65) Prior Publication Data
US 2015/0217969 A1 Aug. 6, 2015

(51) Int. Cl.
*B66B 1/20* (2006.01)
*B66B 1/46* (2006.01)

(52) U.S. Cl.
CPC ..... *B66B 1/468* (2013.01); *B66B 2201/463* (2013.01); *B66B 2201/4615* (2013.01); *B66B 2201/4676* (2013.01)

(58) Field of Classification Search
CPC ..... B66B 1/648; B66B 2201/4615; B66B 2201/463; B66B 2201/4676
(Continued)

(56) References Cited

U.S. PATENT DOCUMENTS 6,801,792 B1 * 10/2004 Schuster ..... B66B 1/468 187/391
8,061,485 B2 * 11/2011 Finschi ..... B66B 1/468 187/384
(Continued)

FOREIGN PATENT DOCUMENTS

CN 101301374 A 11/2008
EP 2471735 A1 4/2012
(Continued)

OTHER PUBLICATIONS

Chinese Office Action and Search Report; Application No. 201280075259.1; dated Aug. 23, 2016; 5 pages.
(Continued)

*Primary Examiner* — Anthony Salata
(74) *Attorney, Agent, or Firm* — Cantor Colburn LLP

(57) ABSTRACT

A method of operating an elevator system includes presenting a credential at a security panel disposed at an elevator system landing of a public area of a building. If the presented credential is correct a contact between the security panel and an elevator control system is opened. Opening of the contact allows for placement of a call via the elevator control system for an elevator car to the landing. An elevator system includes one or more elevator cars located in one or more hoistways. An elevator control system controls movement of the elevator cars. A security panel is operably connected to the elevator control system and located at an elevator system landing. Presenting a correct credential at the security panel opens a contact between the security panel and the elevator control system thus initiating a call of an elevator car of the one or more elevator cars to the landing.

13 Claims, 4 Drawing Sheets

(58) Field of Classification Search
USPC ..... 187/247, 380–388, 391, 393, 396
See application file for complete search history.

(56) References Cited

U.S. PATENT DOCUMENTS

| | | | | |
|---|---|---|---|---|
| 8,151,943 | B2 * | 4/2012 | de Groot | B66B 1/2458 187/382 |
| 8,301,456 | B2 * | 10/2012 | Gazdzinski | G06Q 30/0251 187/384 |
| 8,401,472 | B2 * | 3/2013 | Gerstenkorn | B66B 1/468 187/380 |
| 8,490,754 | B2 * | 7/2013 | Amano | B66B 1/2458 187/384 |
| 8,770,350 | B2 * | 7/2014 | Wilke | B66B 1/468 187/247 |
| 8,813,917 | B2 * | 8/2014 | Salmikuukka | B66B 1/468 187/247 |
| 8,939,263 | B2 * | 1/2015 | Tokura | B66B 1/2458 187/382 |
| 9,174,824 | B2 * | 11/2015 | Tokura | B66B 1/468 |
| 9,382,096 | B2 * | 7/2016 | Finschi | B66B 1/468 |
| 9,463,954 | B2 * | 10/2016 | Kumar | B66B 1/468 |
| 9,580,272 | B2 * | 2/2017 | Kappeler | B66B 1/468 |
| 2006/0259777 | A1 | 11/2006 | Izawa | |
| 2015/0158696 | A1 * | 6/2015 | Miyajima | B66B 1/468 187/381 |
| 2016/0009525 | A1 * | 1/2016 | DePaola | B66B 1/468 187/380 |
| 2016/0035161 | A1 * | 2/2016 | Friedli | B66B 1/468 340/5.28 |
| 2016/0096706 | A1 * | 4/2016 | Tang | B66B 1/468 187/247 |
| 2016/0152439 | A1 * | 6/2016 | MacDonald | B66B 1/46 187/384 |

FOREIGN PATENT DOCUMENTS

| | | | |
|---|---|---|---|
| KR | 20100005871 | A | 1/2010 |
| KR | 20100009337 | A | 1/2010 |
| KR | 101146939 | B1 | 5/2012 |
| KR | 1020120023755 | A | 9/2013 |

OTHER PUBLICATIONS

International Preliminary Report on Patentability; International Application No. PCT/US2012/050751; International Filing Date: Aug. 14, 2012; dated Feb. 17, 2015; 6 Pages.

Notification of Transmittal of the International Search Report and the Written Opinion of the International Searching Authority, or the Declaration; PCT/US2012/050751; dated Mar. 18, 2013; 10 Pages.

Chinese Office Action for application CN 201280075259.1, dated Apr. 19, 2017, 9pgs.

* cited by examiner

SECURITY SYSTEM FOR ELEVATOR

BACKGROUND OF THE INVENTION

The subject matter disclosed herein relates to elevator systems. More specifically, the subject disclosure relates to security systems to control building floor access by elevator passengers.

Controlling access to private spaces, such as secure office floors of a building, from public spaces, such as a building lobby, can be complex and costly. This is especially true in elevator systems utilizing destination dispatching. In destination dispatching, the passenger indicates the destination floor on a destination entry panel in the hallway. This entry is communicated to the elevator system controller, which decides which elevator car the passenger will travel on and directs the passenger to the correct elevator car by, for example, a message on a destination entry panel or an audible signal. Integrating building security into such a system often requires TCP/IP communications that is absent in some buildings. Additionally, significant complexity and cost is added through integration software development and testing.

BRIEF DESCRIPTION OF THE INVENTION

According to one aspect of the invention, a method of operating an elevator system includes presenting a credential at a security panel disposed at an elevator system landing of a public area of a building. If the presented credential is correct a contact between the security panel and an elevator control system is opened. Opening of the contact allows for placement of a call via the elevator control system for an elevator car to the landing.

According to another aspect of the invention, an elevator system includes one or more elevator cars located in one or more hoistways. An elevator control system is utilized to control movement of the one or more elevator cars in the one or more hoistways. A security panel is operably connected to the elevator control system and located at an elevator system landing in a public area of a building. Presenting a correct credential at the security panel opens a contact between the security panel and the control system thus initiating a call of an elevator car of the one or more elevator cars to the landing.

Alternatively in this or other aspects of the invention, a destination entry panel is operably connected to the control system and located at the landing for entry of a selected destination into the control system.

Alternatively in this or other aspects of the invention, opening the contact between the security panel and the control system allows for entry of the selected destination at the destination entry panel.

Alternatively in this or other aspects of the invention, a card reader is located at the security panel.

Alternatively in this or other aspects of the invention, presenting a credential comprises swiping or scanning a card at the card reader.

Alternatively in this or other aspects of the invention, a keypad is located at the security panel.

Alternatively in this or other aspects of the invention, presenting a credential comprises entering a numeric or alphanumeric code at the keypad.

Alternatively in this or other aspects of the invention, a passenger is instructed to seek assistance if an incorrect credential is presented.

The detailed description explains the invention, together with advantages and features, by way of examples with reference to the drawings.

DETAILED DESCRIPTION OF THE INVENTION

Figure 1:
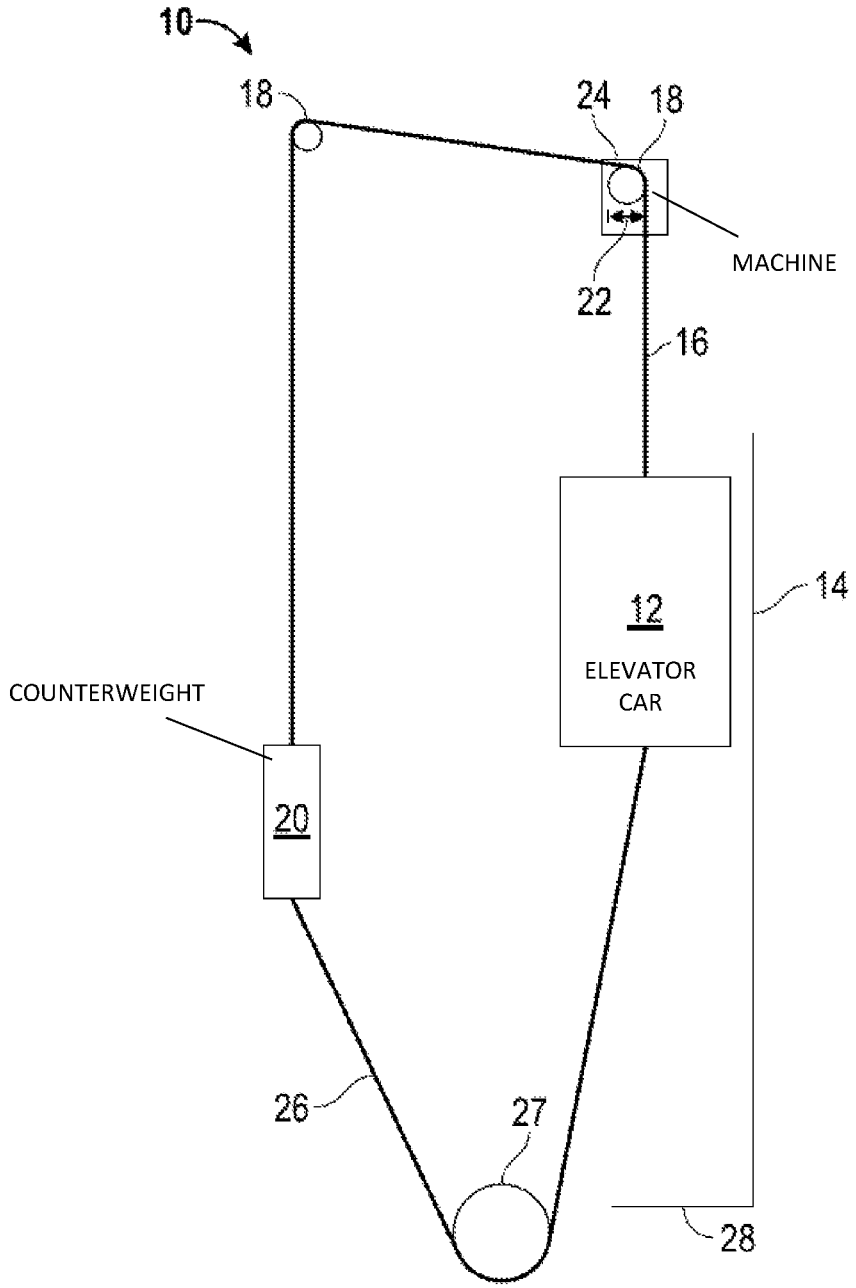
FIG. 1 is a schematic of an exemplary elevator system.

Shown in FIG. 1 is an embodiment of an elevator system 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more suspension members, for example, suspension ropes 16. The one or more suspension ropes 16 interact with one or more sheaves 18 to be routed around various components of the elevator system 10. The one or more suspension ropes 16 are also connected to a counterweight 20, which is used to help balance the elevator system 10 and reduce the difference in rope tension on both sides of the one or more sheaves 18 during operation. The sheaves 18 each have a diameter 22, which may be the same or different than the diameters of the other sheaves 18 in the elevator system 10. At least one of the sheaves 18 could be a drive sheave driven by a machine 24. Movement of the drive sheave by the machine 24 drives, moves and/or propels (through traction) the one or more suspension ropes 16 that are routed around the drive sheave 18 thereby moving the elevator car 12 along the hoistway 14. The elevator system 10 may further include one or more compensation ropes 26 extending from the elevator car 12 toward a hoistway pit 28 around a compensation sheave 27 and up to the counterweight 20.

Figure 2:
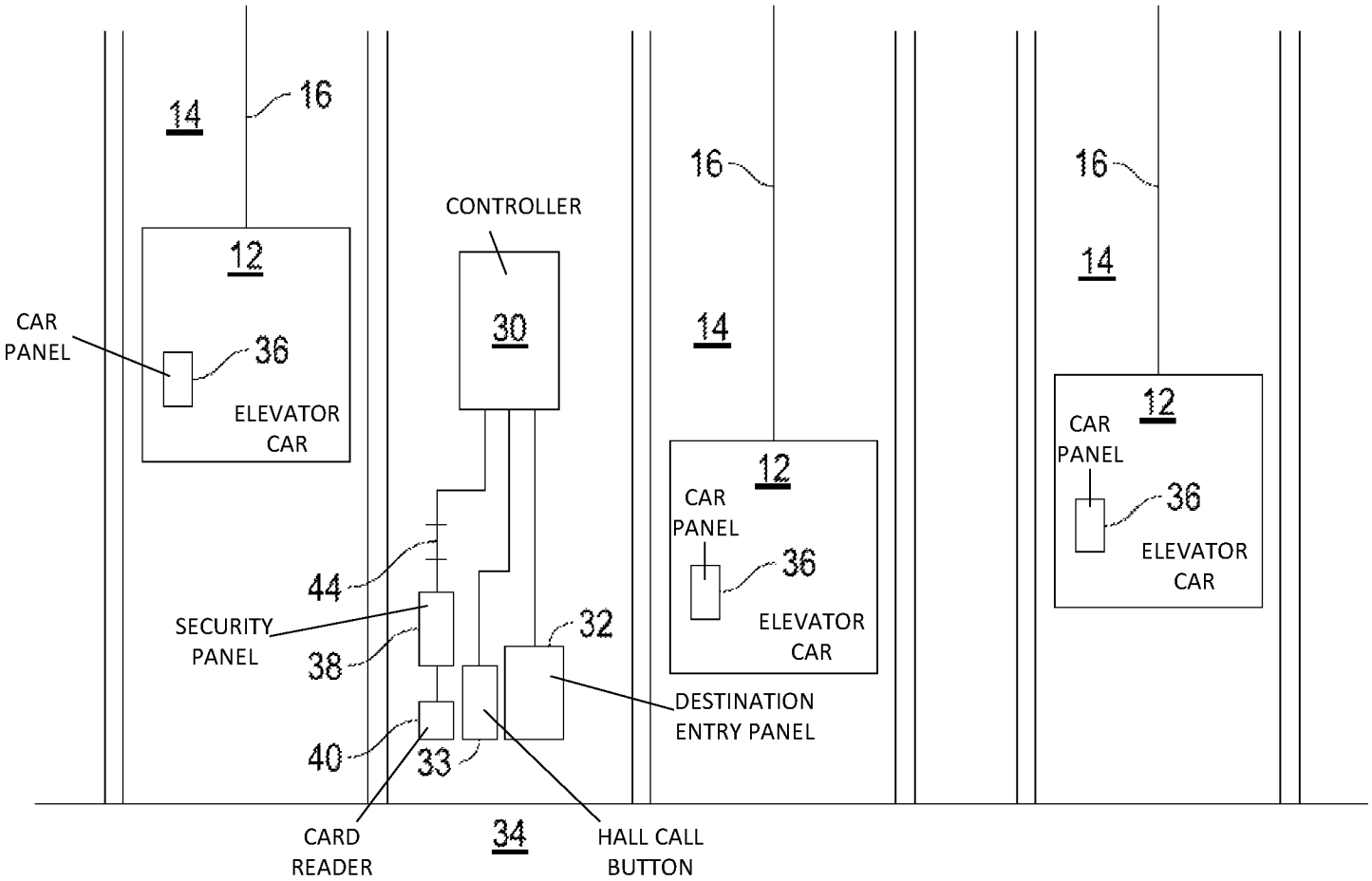
FIG. 2 is a schematic view of an elevator system having multiple hoistways and multiple elevator cars.

As shown in FIG. 2, some elevator systems 10 include multiple hoistways 14 and multiple elevator cars 12 controlled via a controller 30, which may operate in either a destination dispatching mode or in a hall call dispatching mode. In hall call dispatching, the passenger initiates a call by pressing a hall call button 33 located in a landing 34 outside the hoistway 14. Typically, the button pressed will indicate a desired direction of travel (either up or down) of the passenger. Once inside the elevator car 12, the passenger presses a button on a car panel 36 to indicate a destination floor. In destination dispatching, the passenger indicates the destination floor on a destination entry panel 32 in the landing 34. The controller 30 decides which elevator car 12 the passenger will travel on and directs the passenger to the correct elevator car 12 by, for example, a message on the destination entry panel 32 or an audible signal.

In public areas of the building, for example, in a building lobby, a security panel 38 is disposed in the landing 34, or vestibule, and is operably connected to the controller 30. In some embodiments, the security panel 38 includes a card reader 40 at which an access card is swiped or scanned, presenting a credential to the security panel 38, to allow access to the elevator system 10. Unless a correct credential is presented to the security panel 38, the controller 30 will not allow travel via the elevator system 10 from the lobby to private areas of the building, for example, secure office floors or the like. In this way, access to private areas is limited to those who have prior approval for access and present the proper credential.

For example, in a hall call dispatching elevator system 10, the system may require access through the card reader 40 before an up or down hall call button 33 can be activated. Similarly, for a destination dispatch elevator system 10, the prospective passenger in the building lobby or other public area will be required to present the proper credential to the security panel 38 via card reader 40 to activate buttons on the destination entry panel 32 for access to secure or private areas of the building. Practically, this may work in any of several ways. Two of which are provided below by way of example.

Figure 3:
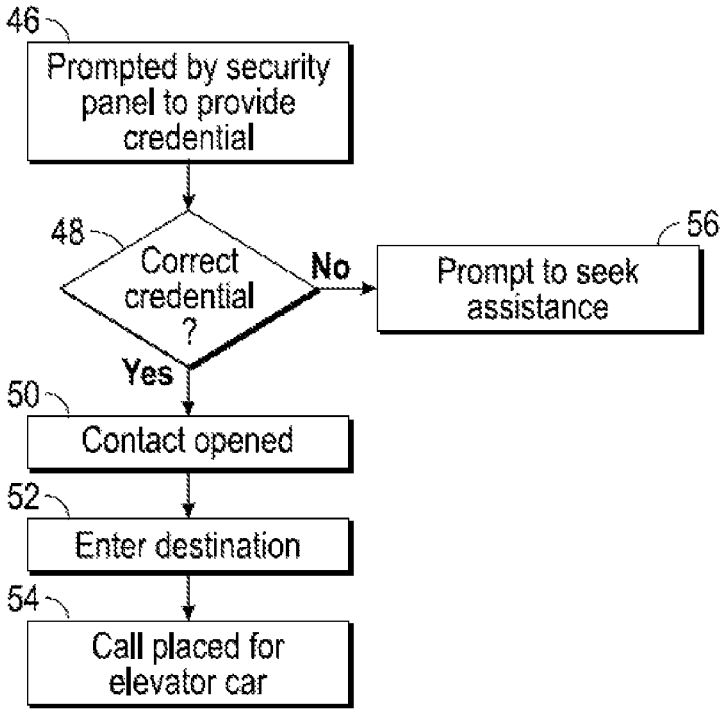
FIG. 3 is a schematic view of operation of an embodiment of an elevator system.

Referring to FIG. 3, first, in block 46 the passenger may be prompted by the security panel 38 to provide the credential. If the security panel 38 determines that the correct credential has been provided in block 48, an electrical contact 44 or switch between the security panel 38 and destination entry panel 32 is opened in block 50, allowing entry of a destination into the destination entry panel 32. In block 52, the passenger enters a destination at the destination entry panel 32. In some embodiments, the passenger may be prompted by the destination entry panel 32 or the security panel 38 to do so. In block 54, the controller 30 places a call for an elevator car 12 to transport the passenger to the selected destination. If the correct credential has not been provided, in block 56 the passenger will be prompted to seek assistance.

Figure 4:
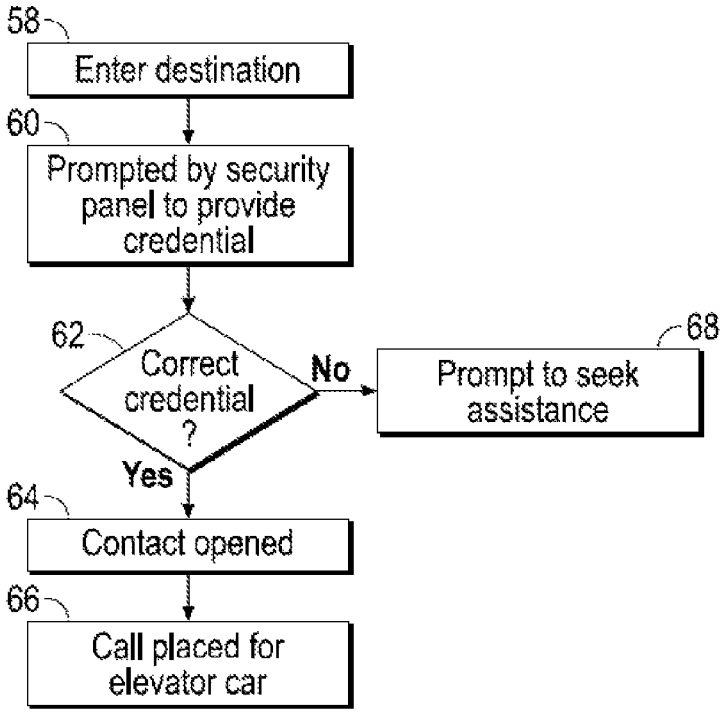
FIG. 4 is a schematic view of operation of another embodiment of an elevator system.

Alternatively, and referring to FIG. 4, in block 58 the passenger may initially enter the destination at the destination entry panel 32. In block 60, upon entry of the destination, the passenger is then prompted to enter their credential at the security panel 38. If the security panel 38 determines the correct credential has been provided in block 62, the contact 44 is opened in block 64, and in block 66 the controller 30 places a call for an elevator car 12 to transport the passenger to the destination. In block 68, if the correct credential has not been provided, once again the passenger will be prompted to seek assistance.

Figure 5:
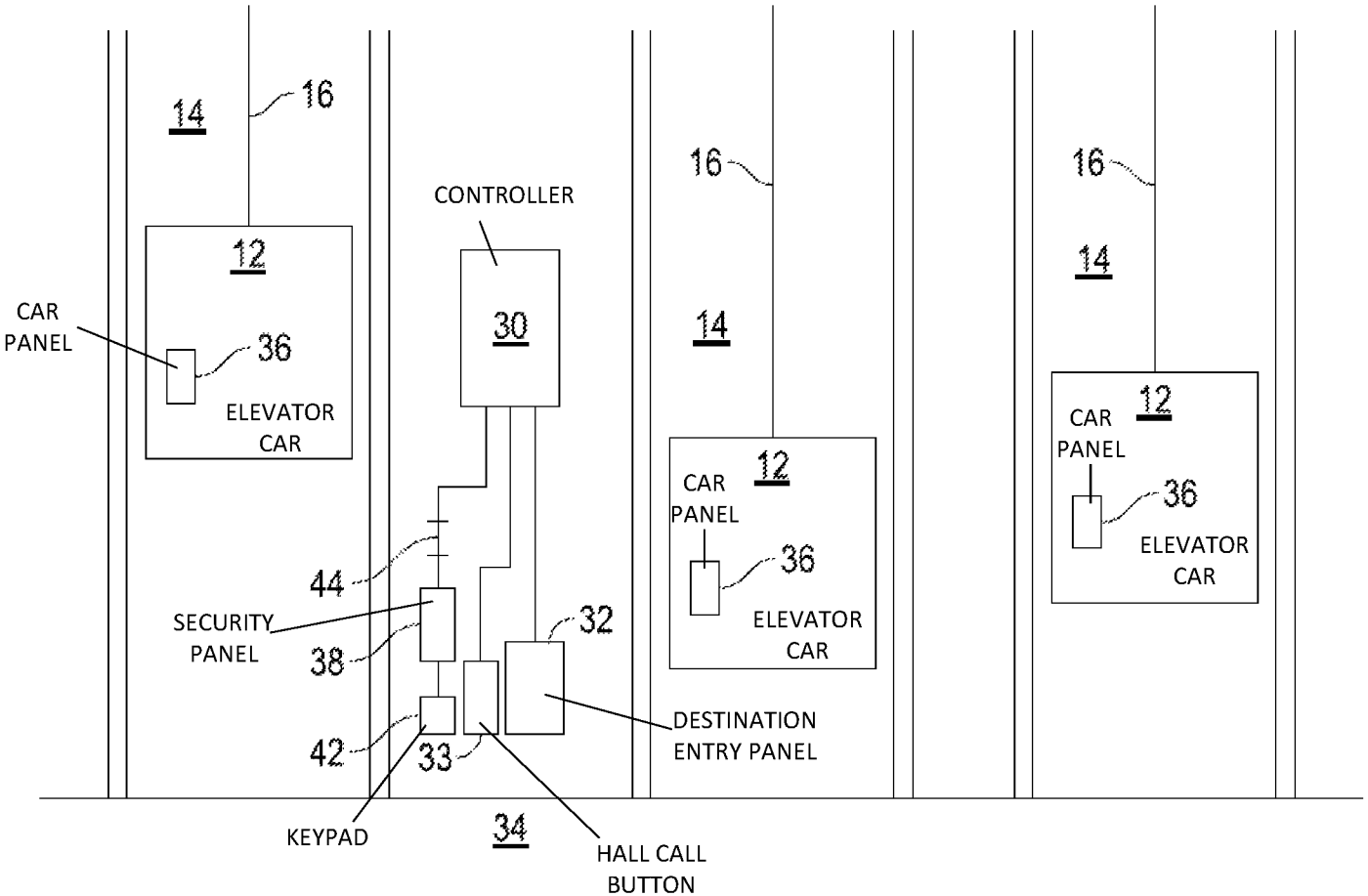
FIG. 5 is a schematic view of yet embodiment of an elevator system.

Referring to FIG. 5, in other embodiments the security panel 38 may include other devices for recognizing a credential. For example, the security panel 38 may include a keypad 42. In such embodiments, the passenger is required to input the correct credential as a numeric or alphanumeric code into the keypad 42.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of operating an elevator system comprising:

presenting a credential at a security panel disposed at an elevator system landing of a public area of a building;

opening an electrical contact between the security panel and an elevator control system if the credential is correct; and placing a call via the elevator control system for an elevator car to the landing once the electrical contact is opened.

2. The method of claim 1, further comprising obtaining a selected destination floor at a destination entry panel disposed at the landing when the electrical contact is opened.

3. The method of claim 1, wherein presenting the credential comprises swiping or scanning a card at a card reader disposed at the security panel.

4. The method of claim 1, wherein presenting the credential comprises entering a code at a keypad disposed at the security panel.

5. The method of claim 1, further comprising instructing a passenger to seek assistance if an incorrect credential is presented.

6. An elevator system comprising:

one or more elevator cars disposed in one or more hoistways;

an elevator control system to control movement of the one or more elevator cars in the one or more hoistways; and a security panel operably connected to the elevator control system and disposed at an elevator system landing in a public area of a building;

wherein presenting a correct credential at the security panel opens a contact between the security panel and the elevator control system thus initiating a call of an elevator car of the one or more elevator cars to the landing.

7. The elevator system of claim 6, further comprising a destination entry panel operably connected to the elevator control system and disposed at the landing for receiving a selected destination into the elevator control system.

8. The elevator system of claim 7, wherein opening the electrical contact between the security panel and the elevator control system allows for entry of the selected destination at the destination entry panel.

9. The elevator system of claim 6, further comprising a card reader disposed at the security panel.

10. The elevator system of claim 9, wherein presenting a credential comprises swiping or scanning a card at the card reader.

11. The elevator system of claim 6, further comprising a keypad disposed at the security panel.

12. The elevator system of claim 11, wherein presenting a credential comprises entering a numeric or alphanumeric code at the keypad.

13. An elevator system, comprising:

one or more hoistways;

one or more elevator cars disposed in the one or more hoistways and movable therein;

an elevator control system to control movement of the one or more elevator cars in the one or more hoistways;

a security panel operably connected to the elevator control system and disposed at an elevator system landing in a public area of a building, the security panel including one or more of a card reader or a keypad to receive a user credential thereat;

an electrical contact disposed in operable communication with both the security panel and the elevator control system, the electrical contact configured to open when a correct user credential is presented at the security panel; and a destination entry panel disposed at the elevator system landing and operably connected to the control system, the destination entry panel activated by the elevator control system in response to the opening of the electrical contact, thereby allowing for a user to request dispatch of an elevator car to the elevator system landing to travel to a selected destination.

* * * * *